US008807385B1

(12) United States Patent
Fosse

(10) Patent No.: US 8,807,385 B1
(45) Date of Patent: Aug. 19, 2014

(54) TAMPER EVIDENT CONTAINER

(71) Applicant: Lindar Corporation, Baxter, MN (US)

(72) Inventor: Daniel K. Fosse, Cambridge, MN (US)

(73) Assignee: Lindar Corporation, Baxter, MN (US)

( * ) Notice: Subject to any disclaimer, the term of this patent is extended or adjusted under 35 U.S.C. 154(b) by 0 days.

(21) Appl. No.: 13/751,709

(22) Filed: Jan. 28, 2013

(51) Int. Cl.
*B65D 41/48* (2006.01)

(52) U.S. Cl.
USPC ..... 220/691; 220/4.23; 220/270; 220/839

(58) Field of Classification Search
USPC ..... 220/266, 270, 391, 682, 4.24, 4.23, 220/4.22, 4.21, 324, 839; 215/224, 225, 215/254, 253, 251, 250; 229/406, 407, 902
See application file for complete search history.

(56) References Cited

U.S. PATENT DOCUMENTS

| | | | | |
|---|---|---|---|---|
| 7,073,680 | B2 | 7/2006 | Boback et al. | |
| 7,118,003 | B2 | 10/2006 | Sellari et al. | |
| 2008/0087669 | A2 | 4/2008 | Boback et al. | |
| 2009/0206082 | A1* | 8/2009 | Vovan | 220/266 |
| 2010/0140267 | A1* | 6/2010 | Sellari et al. | 220/270 |

OTHER PUBLICATIONS http://www.inlineplastics.com/safe_t_fresh.php Inline Plastics Corporation.
http://www.dartcontainer.com/web/products.nsf/files/M-204.pdf/$FILE/M-204.pdf Dart Container Corporation.
http://www.parpak.com/brochures/BreakAway-OCT10-Eng.pdf Par-Pak Corporation, Oct. 2010.
http://www.pactiv.com/products_na/foodservice/data/PWPTamperEvident.pdf PACTIV Foodservice/Food Packaging.
http://www.pactiv.com/Products_NA/Foodservice/data/TESquares.pdf PACTIV Foodservice/Food Packaging.

* cited by examiner

*Primary Examiner* — Mickey Yu
*Assistant Examiner* — Allan Stevens
(74) *Attorney, Agent, or Firm* — Kinney & Lange, P.A.

(57) ABSTRACT

A tamper evident container includes a first container portion, a second container portion, and a tamper evident closure. The tamper evident closure includes a first snap connected to the first container portion, a second snap connected to the second container portion, a tear strip connected to the second snap, and a third snap connected to the tear strip. In a closed position, the first snap is placed in a cavity in the second snap, the third snap is placed in a cavity in the first snap, and the tear strip faces outward from the taper evident container. The container is opened by removing the tear strip and then separating the first snap from the second snap.

18 Claims, 7 Drawing Sheets

TAMPER EVIDENT CONTAINER

BACKGROUND

The present invention relates to containers, and in particular, to a tamper evident design for containers.

Containers can be constructed with various structures and sizes. Two common container structures include clamshell containers and multi-piece containers. Clamshell containers are containers that mimic the form and function of a clamshell. Clamshell containers include a base portion and a cover portion that are attached to one another with a hinge. Multi-piece containers are containers that include a base portion and a cover portion that are separate pieces designed to fit together. Typically, both clamshell containers and multi-piece containers have some form of closure that is capable of holding the cover portion on the base portion when the container is closed. Different types of closures can be used, including self-locking tabs, snaps, or screw tops. Containers can also be held together with means other than closures. These means can include using frictional forces to hold container pieces together, heat sealing the container pieces together, or using staples, adhesives, or labels to hold the container pieces together.

Containers are typically secured using standard closures that allow a user to open and close the container with no consequence. Containers can also be secured with tamper evident or tamper proof closures. These types of closures include a feature that will make it obvious that the container has been opened. A container with a tamper evident or a tamper proof closure will be irreversibly altered when the container is opened for the first time.

SUMMARY

According to the present invention, a tamper evident container includes a first container portion, a second container portion, and a tamper evident closure. The tamper evident closure includes a first snap connected to the first container portion, a second snap connected to the second container portion, a tear strip connected to the second snap, and a third snap connected to the tear strip. In a closed position, the first snap is placed in a cavity in the second snap, and the third snap is placed in a cavity in the first snap. Also in a closed position, the tear strip faces outward from the tamper evident container.

DETAILED DESCRIPTION

In general, the present invention relates to a tamper evident design for containers. Containers are used in many industries as a form of packaging for products that are commercially available. To indicate when someone has opened a package, some form of tamper evident or tamper proof means is used. A tamper evident indicator will indicate that the package has been opened, so that someone purchasing or using the product can ensure that the package includes all of the necessary contents and is safe to use.

Figure 1:
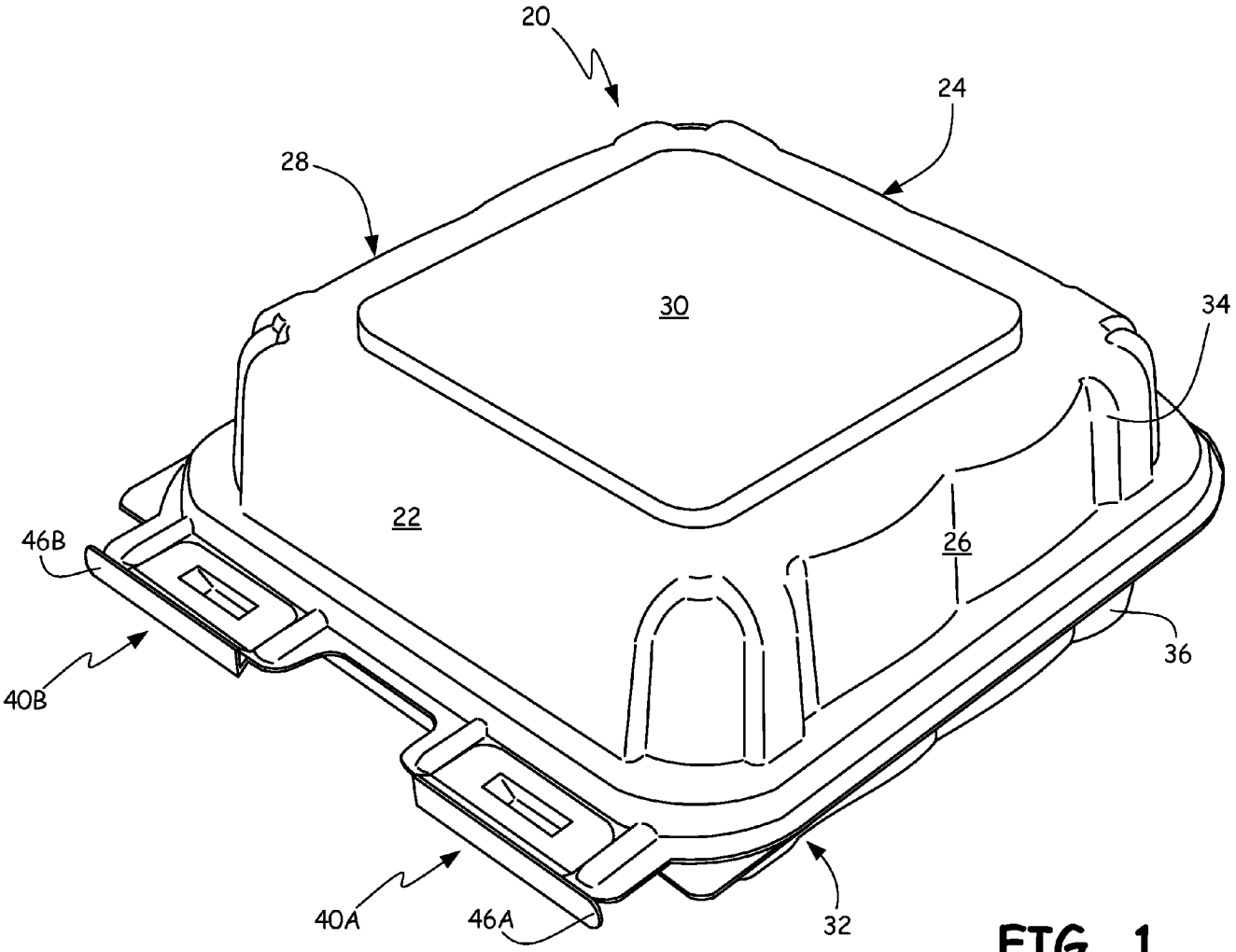
FIG. 1 is a perspective view of a tamper evident container in a closed position.
Figure 2:
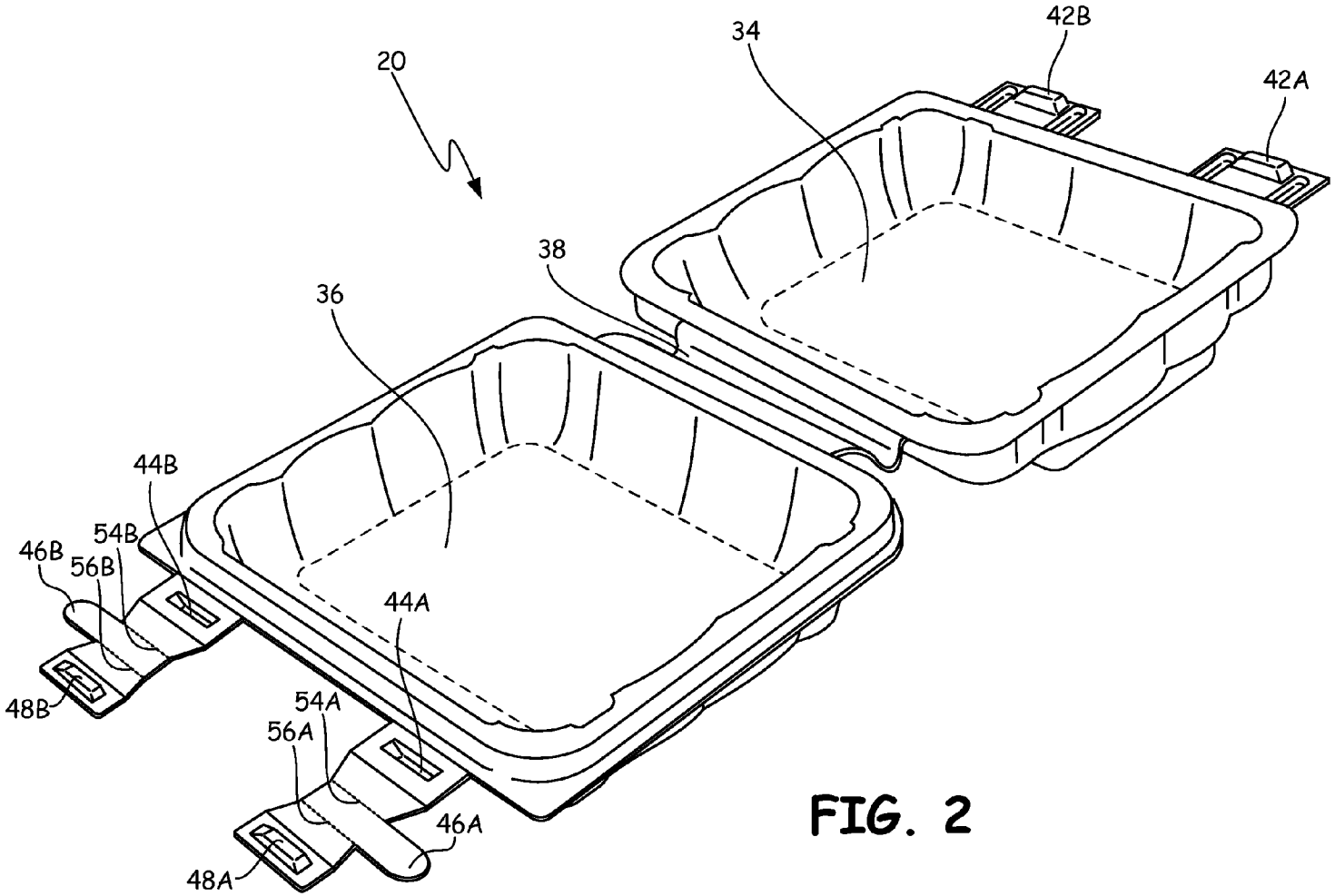
FIG. 2 is a perspective view of the tamper evident container of FIG. 1 in an open position.

FIGS. 1-2 show tamper evident container 20. FIG. 1 is a perspective view of tamper evident container 20 in a closed position. FIG. 2 is a perspective view of tamper evident container 20 in an open position. Tamper evident container 20 includes front side 22, rear side 24, first side 26, second side 28, top side 30, and bottom side 32 when it is in a closed position. Tamper evident container 20 further includes first container portion (cover) 34, second container portion (base) 36, hinge 38, and tamper evident closures 40A and 40B. Tamper evident closure 40A includes first snap 42A, second snap 44A, tear strip 46A, third snap 48A, perforated line 54A, and perforated line 56A. Tamper evident closure 40B includes first snap 42B, second snap 44B, tear strip 46B, third snap 48B, perforated line 54B, and perforated line 56B. Tamper evident closures 40A and 40B include the same components but are placed at different locations on tamper evident container 20. Tamper evident container 20 is made out of plastic in the embodiment shown, but any suitable material can be used.

First container portion 34 is attached to second container portion 36 along hinge 38. Hinge 38 is located on rear side 24 of tamper evident container 20 when tamper evident container 20 is in a closed position. As seen in FIG. 1, first container portion 34 fits on second container portion 36. As seen in FIG. 2, first container portion 34 is attached to first snaps 42A and 42B. Second container portion 36 is attached to second snaps 44A and 44B. Second snaps 44A and 44B are attached to tear strips 46A and 46B along perforated lines 54A and 54B, respectively. Tear strips 46A and 46B are attached to third snaps 48A and 48B along perforated lines 56A and 56B, respectively. When tamper evident container 20 is in a closed position, tamper evident closures 40A and 40B are located on front side 22 of tamper evident container 20. In alternate embodiments, tamper evident closures 40A and 40B may be located on any side of container 20. Tamper evident closure 40A is formed by fitting first snap 42A, second snap 44A, tear strip 46A and third snap 48A together. Tamper evident closure 40B is formed by fitting first snap 42B, second snap 44B, tear strip 46B, and third snap 48B together.

As seen in FIG. 1, when tamper evident container 20 is in a closed position, tamper evident closures 40A and 40B are positioned so that tear strips 46A and 46B face outward of tamper evident container 20. To open tamper evident container 20, a user can grab tear strips 46A and 46B between their fingers and pull them away from tamper evident container 20. Tear strips 46A and 46B are attached to first snaps 44A and 44B and second snaps 48A and 48B along perforated lines 54A and 54B and perforated lines 56A and 56B, respectively. When tear strips 46A and 46B are pulled away from tamper evident container 20, perforated lines 54A and 54B and perforated lines 56A and 56B separate so that tear strips 46A and 46B can be removed from tamper evident container 20. Once tear strips 46A and 46B are removed, tamper evident closures 40A and 40B can be opened and closed.

Tamper evident closures 40A and 40B create a container that is tamper evident. To open tamper evident container 20, a user must grab tear strips 46A and 46B and pull them away and remove them from tamper evident container 20. Once tear strips 46A and 46B are removed from tamper evident container 20, a user can open and close tamper evident closures 40A and 40B. This allows a user to open and close tamper evident container 20 an infinite number of times, even if tamper evident container 20 will no longer have tamper evident features after it is opened for the first time. Tamper evident container 20 can be assembled by hand, which allows someone to use the container to package his or her own products. Tamper evident container 20 can be used in a variety of different ways. First, tamper evident container 20 can be used to package food. Having a tamper evident package for food is advantageous, as consumers can ensure that the food has not been tampered with prior to purchasing it. Second, tamper evident container 20 can be used to package products. Having a tamper evident package for products can ensure consumers that all of the parts are in the package and that the product has not been tampered with prior to purchasing it.

Figure 3A:
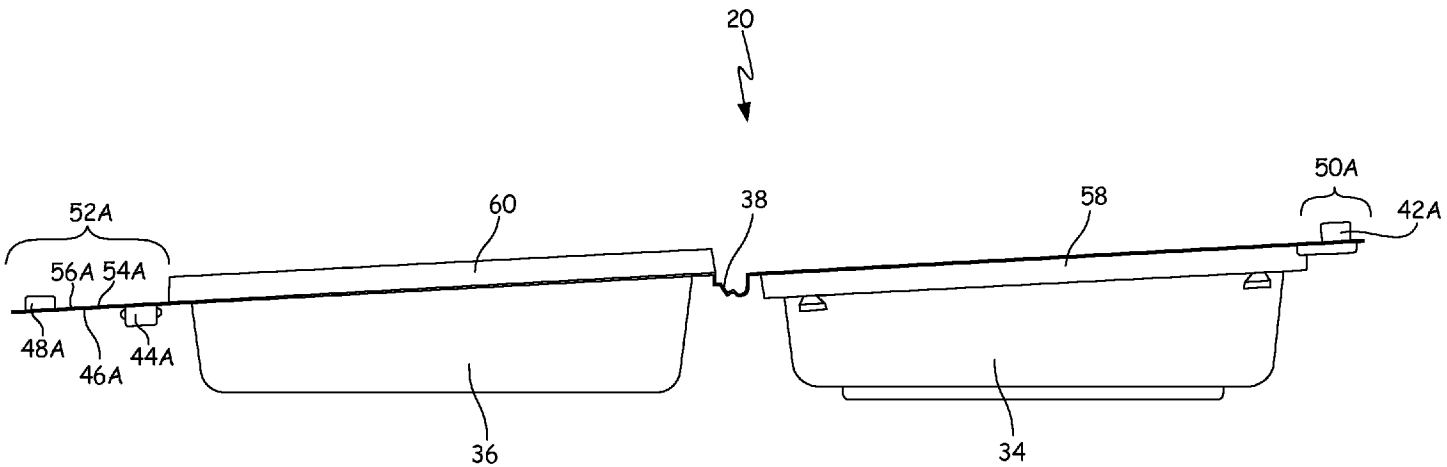
FIG. 3A is a side elevation view of the tamper evident container of FIG. 1 in an open position.
Figure 3B:
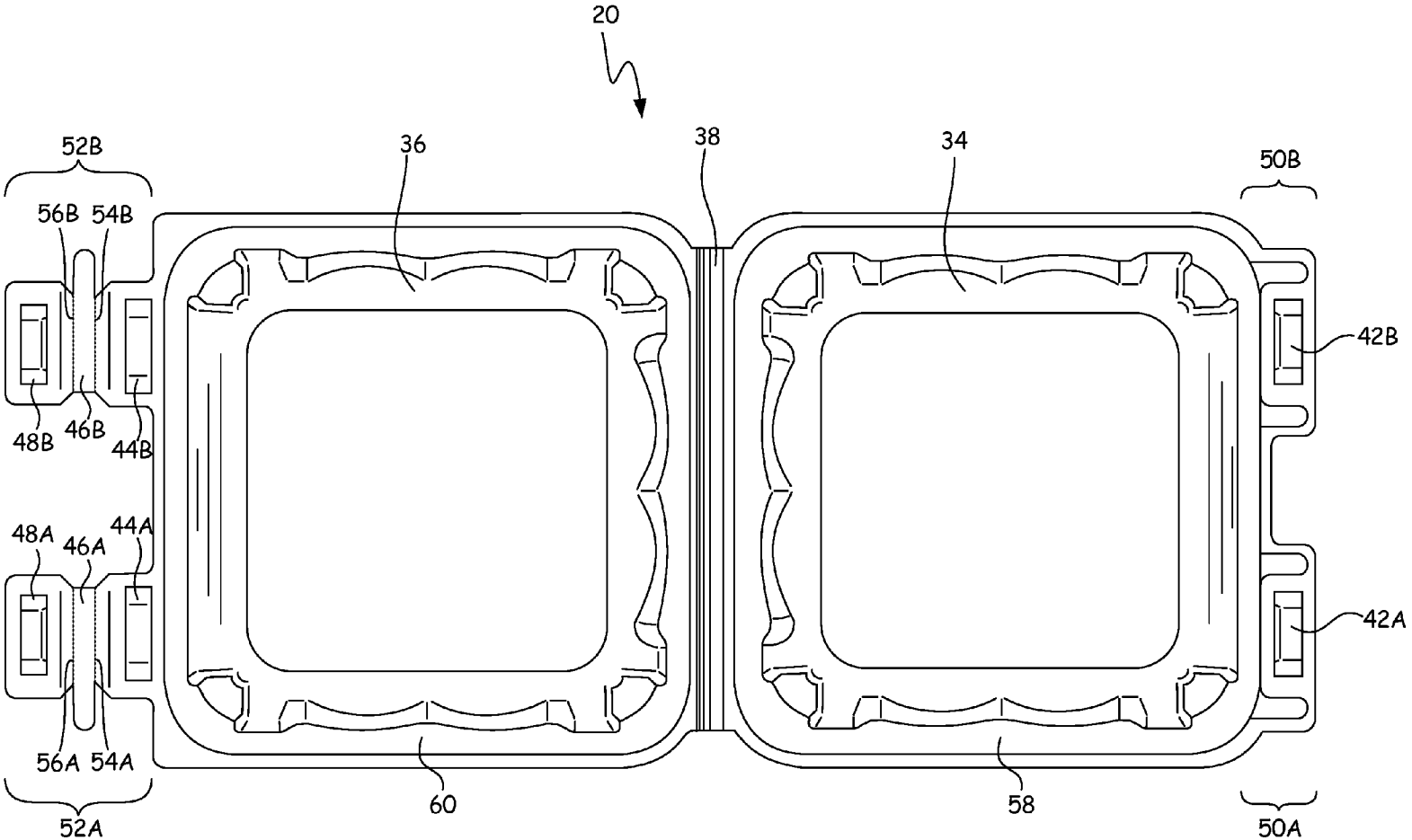
FIG. 3B is a top plan view of the tamper evident container of FIG. 1 in an open position.

FIGS. 3A-3B show tamper evident container 20 in an open position. FIG. 3A is a side elevation view of tamper evident container 20 in an open position. FIG. 3B is a top plan view of tamper evident container 20 in an open position. Tamper evident container 20 includes first container portion 34, second container portion 36, hinge 38, first rim 58, second rim 60, first flanges 50A and 50B, and second flanges 52A and 52B. First flange 50A includes first snap 42A, and first flange 50B includes first snap 42B. Second flange 52A includes second snap 44A, tear strip 46A, third snap 48A, perforated line 54A, and perforated line 56A. Second flange 52B includes second snap 44B, tear strip 46B, third snap 48B, perforated line 54B, and perforated line 56B.

First container portion 34 includes rim 58 on an outer periphery. Second container portion 36 includes rim 60 on an outer periphery. First container portion 34 is connected to second container portion 36 along hinge 38. Hinge 38 has a curved shape and can bend when tamper evident container 20 is closed. First flanges 50A and 50B are attached to first container portion 34. Second flanges 52A and 52B are attached to second container portion 36.

First flanges 50A and 50B have substantially rectangular shapes. First snaps 42A and 42B are located on first flanges 50A and 50B. First flanges 50A and 50B extend horizontally outward of first snaps 42A and 42B to provide a surface that can be grasped by a user to open and close tamper evident container 20. First snaps 42A and 42B have a substantially rectangular shape and project upwards from first flanges 50A and 50B. First snaps 42A and 42B have a cavity formed on the inside of the upward projection that can be accessed on the bottom side of first flanges 50A and 50B. In alternate embodiments, first snaps 42A and 42B can have any shape, including but not limited to, a square shape, a circular shape, or an oval shape.

Second flanges 52A and 52B also have substantially rectangular shapes. Second snaps 44A and 44B, tear strips 46A and 46B, third snaps 48A and 48B, perforated lines 54A and 54B, and perforated lines 56A and 56B are located on first flanges 52A and 52B. Second flanges 52A and 52B extend horizontally outward of second snaps 44A and 44B and third snaps 48A and 48B to provide a surface that can be gasped by a user to open and close tamper evident container 20. Second snaps 44A and 44B are attached to tear strips 46A and 46B along perforated lines 54A and 54B, respectively. Tear strips 46A and 46B are attached to third snaps 48A and 48B along perforated lines 56A and 56B, respectively. Second snaps 44A and 44B have a substantially rectangular shape and project downwards from second flanges 52A and 52B. Second snaps 44A and 44B have a cavity formed on the inside of the downwards projections that can be accessed on the top side of second flanges 52A and 52B. Third snaps 48A and 48B have a substantially rectangular shape and project upwards from second flanges 52A and 52B. Third snaps 48A and 48B have a cavity formed on the inside of the upward projections that can be accessed on the bottom side of second flanges 52A and 52B. In alternate embodiments, second snaps 44A and 44B and third snaps 48A and 48B can have any shape, including but not limited to, a square shape, a circular shape, or an oval shape.

Perforated lines 54A and 54B and perforated lines 56A and 56B are straight lines that run across second flanges 52A and 52B. Perforated lines 54A and 54B and perforated lines 56A and 56B can be made from perforations of any suitable size. Tear strips 56A and 56B have a square edge on a first end and a rounded edge on a second end. The square edge of tear strips 56A and 56B is in line with second snaps 44A and 44B and third snaps 48A and 48B. The rounded edge of tear strips 56A and 56B extends horizontally outward past second snaps 44A and 44B and third snaps 48A and 48B. The rounded edge can be grabbed by a user to remove tear strips 56A and 56B from tamper evident container 20. In alternate embodiments, tear strips 56A and 56B can have alternate shapes and can extend outward from second snaps 44A and 44B and third snaps 48A and 48B in various manners.

Tamper evident container 20 is manufactured in the open position, as seen in FIGS. 3A-3B. Tamper evident container 20 is manufactured using common container and packaging manufacturing techniques. Manufacturing tamper evident container 20 in the open position allows tamper evident container 20 to be stacked in a substantially flat manner for shipping. This allows multiple containers to be shipped in a single box, which saves space and cost. Being able to stack tamper evident container 20 while it is in the open position also saves space when storing tamper evident container 20.

Figure 4A:
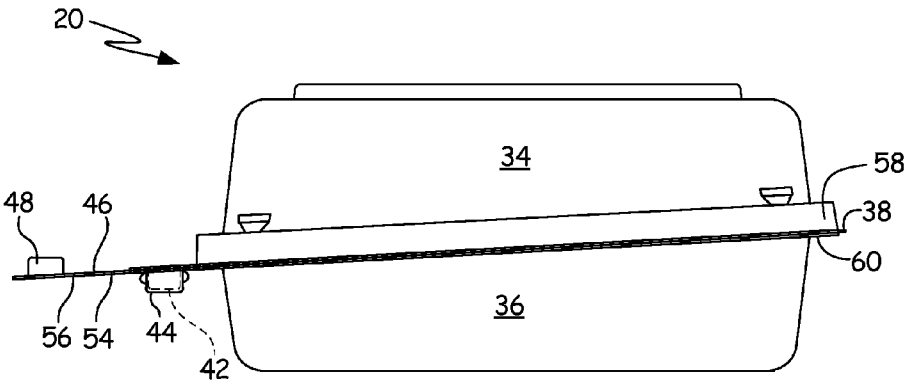
FIG. 4A is a side elevation view of the tamper evident container of FIG. 1 in a partially closed position.
Figure 4B:
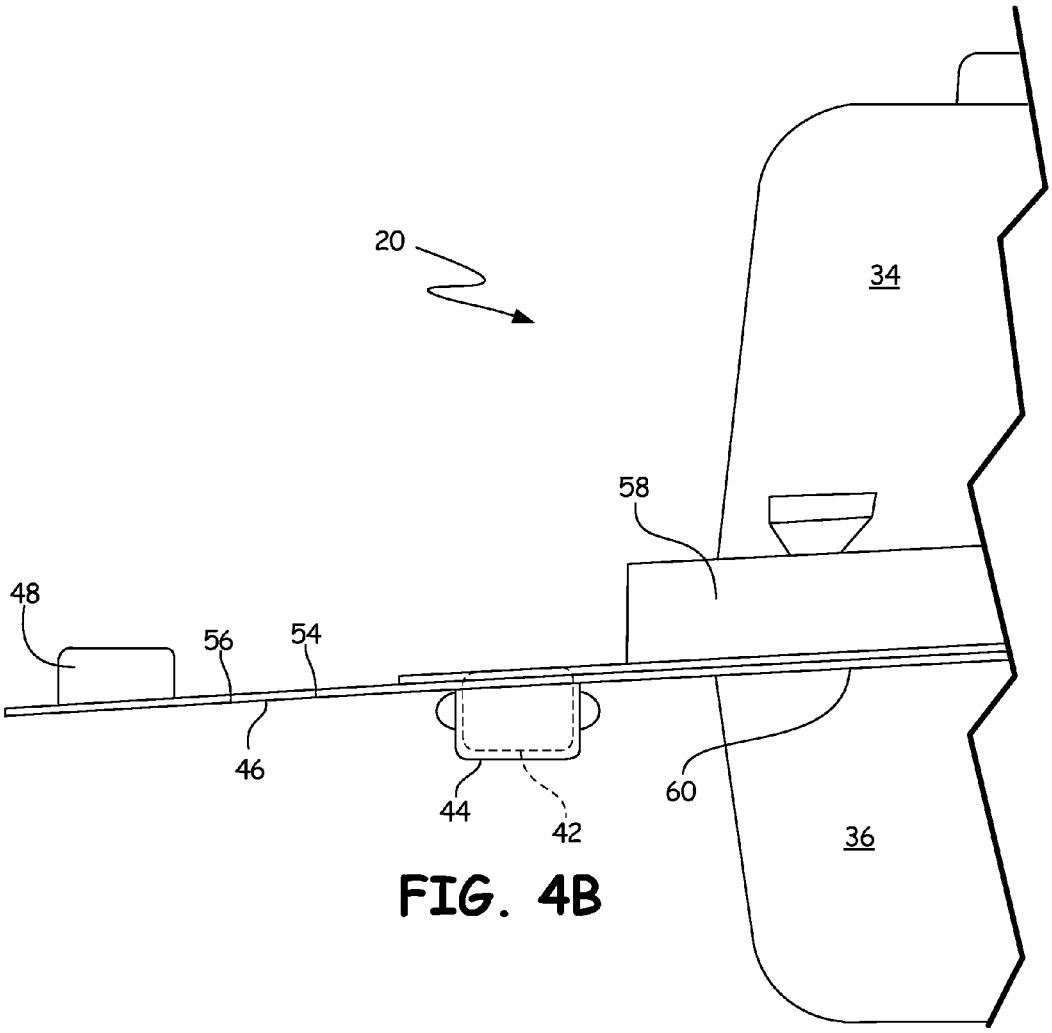
FIG. 4B is a cut-away side elevation view of the tamper evident container of FIG. 1 in a partially closed position.

FIGS. 4A-4B show tamper evident container 20 in a partially closed position. FIG. 4A is a side elevation view of tamper evident container 20 in a partially closed position. FIG. 4B is a cut-away side elevation view of tamper evident container 20 in a partially closed position. Tamper evident container 20 includes first container portion 34, second container portion 36, hinge 38, first rim 58, second rim 60, first snap 42, second snap 44, perforated line 54, tear strip 46, perforated line 56, and third snap 48.

First container portion 34 includes first rim 58, and second container portion 36 includes second rim 60. First container portion 34 is connected to second container portion 36 along hinge 38. In a partially closed position, first container portion 34 is folded to fit on second container portion 36. First rim 58 of first container portion 34 fits onto second rim 60 of second container portion 36 to close tamper evident container 20.

After first container portion 34 has been placed on second container portion 36, first snap 42 can be placed in the cavity of second snap 44. First snap 42 fits in second snap 44 so that the two portions can be held together with friction forces when there is no outside pressure being applied to them. When outside pressure is applied, first snap 42 can be removed from second snap 44 so tamper evident container 20 can be opened. First snap 42 and second snap 44 act as a typically snap-lock feature that can be closed and opened with no consequence.

Figure 5A:
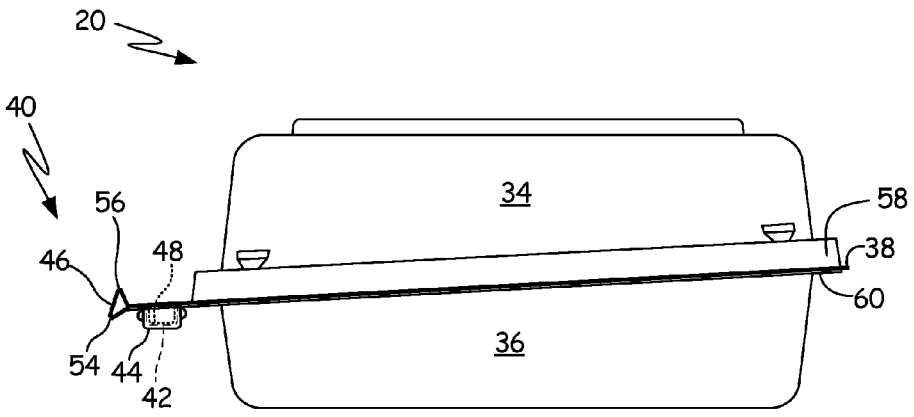
FIG. 5A is a side elevation view of the tamper evident container of FIG. 1 in a closed position.
Figure 5B:
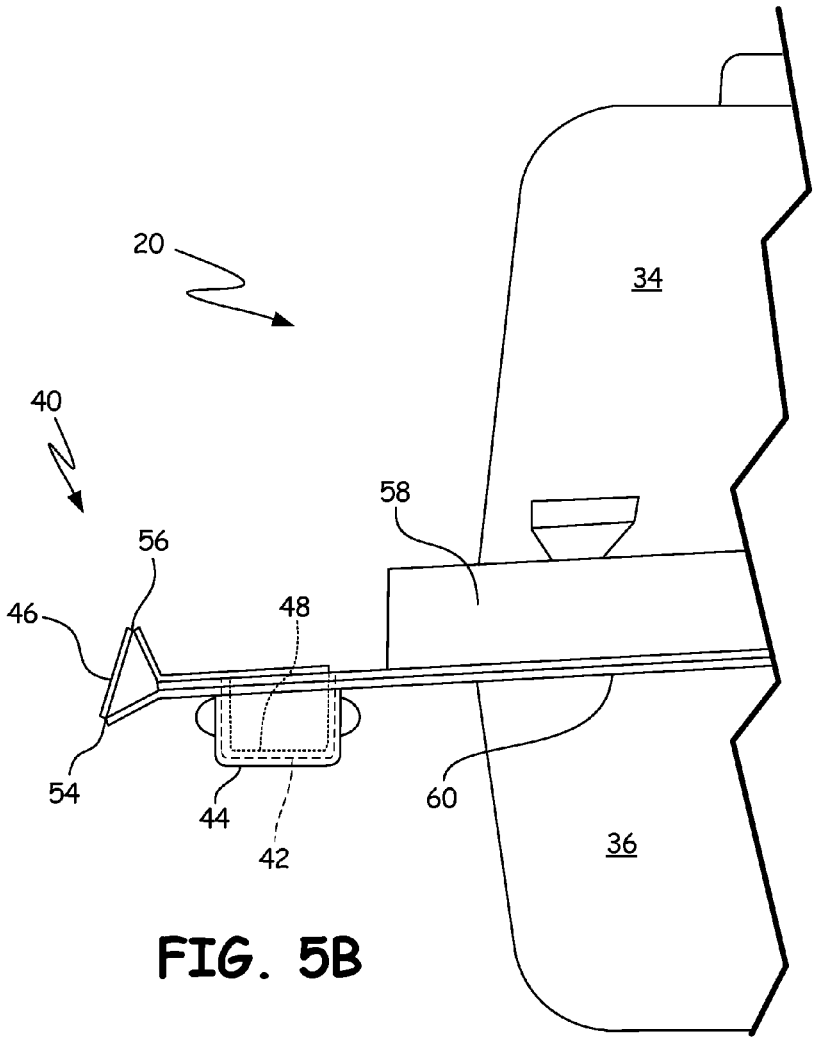
FIG. 5B is a cut-away side elevation view of the tamper evident container of FIG. 1 in a closed position.

FIGS. 5A-5B show tamper evident container 20 in a closed position. FIG. 5A is a side elevation view of tamper evident container 20 in a closed position. FIG. 5B is a cut-away side elevation view of tamper evident container 20 in a closed position. Tamper evident container 20 includes first container portion 34, second container portion 36, hinge 38, first rim 58, second rim 60, first snap 42, second snap 44, perforated line 54, tear strip 46, perforated line 56, and third snap 48.

To fully close tamper evident container 20, tear strip 46 and third snap 48 can be folded around the snap-lock closure consisting of first snap 42 and second snap 44. Third snap 48 can then be placed in the cavity of first snap 42. Third snap 48 is designed to have a tight fit with the cavity of first snap 42 so that there are no voids between the two snaps when tamper evident container 20 is closed. Having a tight fit between third snap 48 and first snap 42 makes it very difficult, if not impossible, for tamper evident container 20 to be opened without permanently altering tamper evident closure 40 or tamper evident container 20.

Placing third snap 48 in first snap 42 leaves tear strip 46 facing outwards from tamper evident container 20. When tear strip 46 and third snap 48 are folded, perforated line 54 and perforated line 56 bend so that tear strip 46 can face outwards. Bending perforated line 54 and perforated line 56 weakens them so that tear strip 46 can be removed easily. To remove tear strip 46, a user can grab the rounded edge of tear strip 46 and pull tear strip 46 outwards and away from tamper evident container 20. When tear strip 46 is pulled outward and away from tamper evident container 20, perforated line 54 and perforated line 56 break apart. This allows for the easy removal of tear strip 46. Once tear strip 46 is removed, tamper evident closure 40 can be opened by pulling first snap 42 out of the cavity of second snap 44. Third snap 48 remains in the cavity of first snap 42 when first snap 42 is removed from second snap 44.

Third snap 48 is designed to fit tightly in first snap 42 with no voids so that tamper evident container 20 can not be opened without first removing tear strip 46. The tight fit between third snap 48 and first snap 42 reduces the potential of someone being able to open the container with a sharp or pointed object. It also reduces the potential of someone being able to open tamper evident container 20 without first removing tear strips 46A and 46B. Tamper evident closure 40 is a closure that can be closed for the first time by a user to create a tamper evident seal. After it is opened for the first time and tear strip 46 is removed, tamper evident closure 40 operates like a typical snap-lock closure so that tamper evident container 20 can be opened and closed an infinite number of times. Tamper evident closure 40 is advantageous for this reason, as it allows a user to utilize a tamper evident closure on a container while allowing the container to be opened and closed an infinite number of times after it is opened for the first time. Tamper evident container 20 is permanently altered when tear strip 46 is removed, but the permanent alteration does not prevent a user for opening and closing the container after that point.

Figure 6:
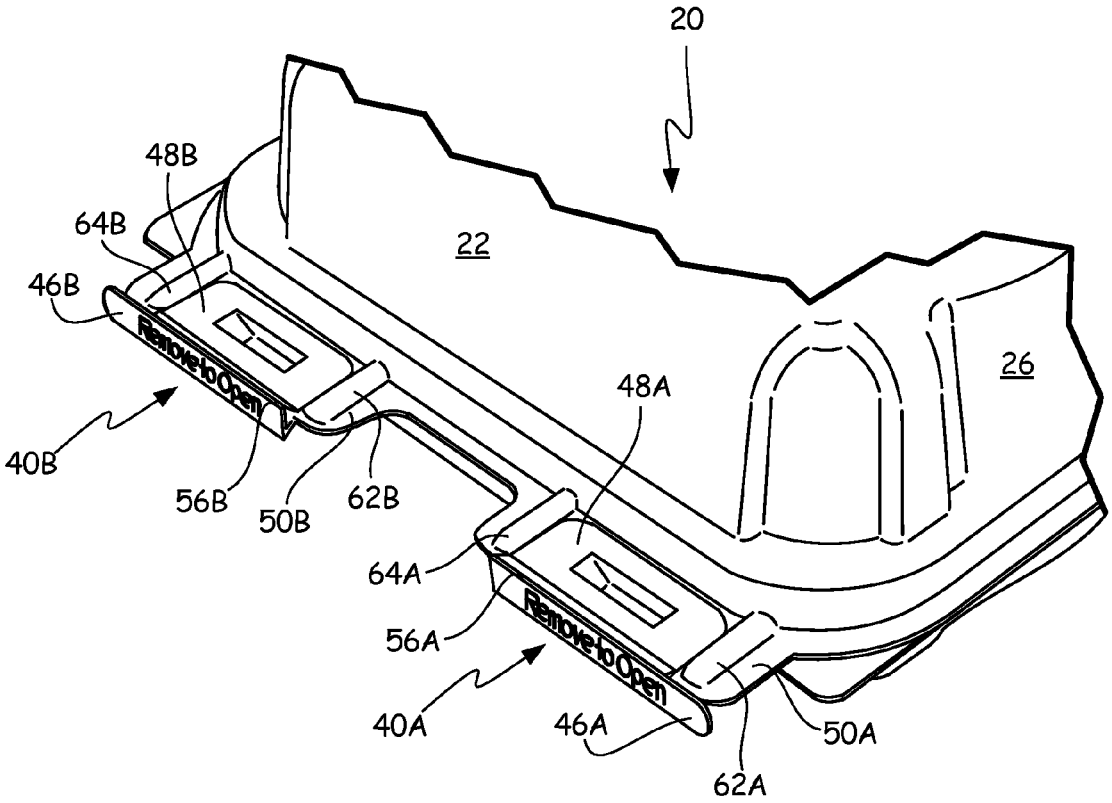
FIG. 6 is a cut-away perspective view of the tamper evident container of FIG. 1 in a closed position.

FIG. 6 is a cut-away perspective view of tamper evident container 20 in a closed position. Tamper evident container 20 includes tamper evident closure 40A and tamper evident closure 40B. Tamper evident closure 40A includes first flange 50A, second flange 52A, tear strip 46A, perforated line 56A, third snap 48A, first rib 62A, and second rib 64A. Tamper evident closure 40B includes first flange 50B, second flange 52B, tear strip 46B, perforated line 56B, third snap 48B, first rib 62B, and second rib 64B.

First rib 62A and second rib 64A are located on opposing sides of first flange 50A and project upwards from first flange 50A. First rib 62A and second rib 64A help guide third snap 48A into tamper evident closure 40A. After third snap 48A is placed into tamper evident closure 40A, first rib 62A and second rib 64A put pressure on third snap 48A and create a tight fit of tamper evident closure 40A that makes it very difficult to open tamper evident closure 40A. First rib 62A and second rib 64A surround third snap 48A when it is placed in tamper evident closure 40A, making it very difficult to access an edge of third snap 48A. This arrangement makes it very difficult for anyone to open tamper evident closure 40A without removing tear strip 46A. First rib 62B and second rib 64B are located on opposing sides of first flange 50B and project upwards from first flange 50B. First rib 62B and second rib 64B help guide third snap 48B into tamper evident closure 40B. After third snap 48B is placed into tamper evident closure 40B, first rib 62B and second rib 64B put pressure on third snap 48B and create a tight fit of tamper evident closure 40B that makes it very difficult to open tamper evident closure 40B. First rib 62B and second rib 64B surround third snap 48B when it is placed in tamper evident closure 40B, making it very difficult to access an edge of third snap 48B. This arrangement makes it very difficult for anyone to open tamper evident closure 40B without removing tear strip 46B.

When tamper evident closures 40A and 40B are fully closed, tear strips 46A and 46B face outwards from tamper evident container 20. Tear strips 46A and 46B have the words "Remove to Open" written across the front, as seen in FIG. 6. This indicates to a user that tear strips 46A and 46B should be removed prior to opening tamper evident container 20. The wording "Remove to Open" can be added to tear strips 46A and 46B in any suitable manner, including printing and embossing. Tear strips 46A and 46B have a rounded edge that a user can grasp to pull them off of tamper evident container 20. This removes the tamper evident features from tamper evident container 20, and tamper evident container 20 can then be opened and closed by grasping first flanges 50A and 50B and pulling tamper evident closures 40A and 40B apart.

In the embodiment shown, tamper evident container 20 is a clamshell container with first container portion 34 connected to second container portion 36 along hinge 38. In alternate embodiments, tamper evident container 20 can be a multi-piece container. Further, in the embodiment shown, tamper evident container 20 has two tamper evident closures 40A and 40B. In alternate embodiments, the number of tamper evident closures can vary and can include just one tamper evident closure. Additionally, the size, shape, and placement of the tamper evident closures can vary depending on the structure of the container.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A tamper evident container comprising:

a first container portion;

a second container portion; and a first tamper evident closure comprising:

a first snap connected to the first container portion;

a second snap connected to the second container portion;

a tear strip connected to the second snap; and a third snap connected to the tear strip;

wherein in a closed position, the first snap is placed in a cavity in the second snap, the third snap is placed in a cavity in the first snap, and the tear strip faces outward from the tamper evident container; and wherein the tear strip can be removed from the first tamper evident closure, and thereafter the first snap and the second snap can be opened and closed repeatedly to open and close the tamper evident container.

2. The tamper evident container of claim 1, wherein the first container portion and the second container portion are attached with a hinge.

3. The tamper evident container of claim 1, wherein the tamper evident container is made out of plastic.

4. The tamper evident container of claim 1, wherein the tear strip is connected to the second snap along a perforated line.

5. The tamper evident container of claim 1, wherein the third snap is connected to the tear strip along a perforated line.

6. The tamper evident container of claim 1, and further comprising:

a second tamper evident closure comprising:

a first snap connected to the first container portion;

a second snap connected to the second container portion;

a tear strip connected to the second snap; and a third snap connected to the tear strip.

7. The tamper evident container of claim 6, wherein the first tamper evident closure and the second tamper evident closure are located on a first side of the tamper evident container.

8. The tamper evident container of claim 1, wherein the first snap has a secure fit with the cavity of the second snap and can be removed from the cavity of the second snap and reinserted into the cavity of the second snap.

9. The tamper evident container of claim 1, wherein the third snap has a tight fit with the cavity of the first snap and cannot be removed from the cavity of the first snap.

10. The tamper evident container of claim 1, wherein the first container portion is a cover and the second container portion is a base.

11. A method comprising:

closing a tamper evident container by bringing a first container portion into contact with a second container portion;

placing a first snap in a cavity of a second snap to form a first closure, wherein the first snap is connected to the first container portion and the second snap is connected to the second container portion, and wherein the first snap securely fits in the cavity of the second snap so that the first snap can be removed from and reinserted into the cavity of the second snap;

folding a tear strip and a third snap around the first closure, wherein the tear strip is connected to the second snap and the third snap is connected to the tear strip; and placing the third snap in a cavity of the first snap, wherein the third snap tightly fits in the cavity of the first snap and cannot be removed from the cavity of the first snap.

12. The method of claim 11, and further comprising:

tearing the tear strip off of the first closure;

discarding the tear strip;

opening the first closure by separating the first snap from the second snap; and disconnecting the first container portion from the second container portion.

13. The method of claim 11, and further comprising:

placing a first snap in a cavity of a second snap to form a second closure, wherein the first snap is connected to the first container portion and the second snap is connected to the second container portion, and wherein the first snap securely fits in the cavity of the second snap so that the first snap can be removed from and reinserted into the cavity of the second snap;

folding a tear strip and a third snap around the second closure, wherein the tear strip is connected to the second snap and the third snap is connected to the tear strip; and placing the third snap in a cavity of the first snap, wherein the third snap tightly fits in the cavity of the first snap and cannot be removed from the cavity of the first snap.

14. The method of claim 13, and further comprising:

tearing the tear strip off of the second closure;

discarding the tear strip; and opening the second closure by separating the first snap from the second snap.

15. The method of claim 11, wherein the tear strip is connected to the second snap along a perforated line.

16. The method of claim 11, wherein the tear strip is connected to the third snap along a perforated line.

17. The method of claim 11, wherein the first container portion and the second container portion are connected with a hinge.

18. The method of claim 11, wherein the first container portion is a cover and the second container portion is a base.

* * * * *